US010367298B2

(12) United States Patent
Plested et al.

(10) Patent No.: US 10,367,298 B2
(45) Date of Patent: Jul. 30, 2019

(54) ELECTRICAL CONNECTOR

(71) Applicant: HARWIN PLC, Portsmouth, Hampshire (GB)

(72) Inventors: Mark Plested, Portsmouth (GB); Scott Flower, Portsmouth (GB); Andrew McQuilken, Portsmouth (GB)

(73) Assignee: HARWIN PLC, Hampshire (GB)

( * ) Notice: Subject to any disclaimer, the term of this patent is extended or adjusted under 35 U.S.C. 154(b) by 0 days.

(21) Appl. No.: 15/800,284

(22) Filed: Nov. 1, 2017

(65) Prior Publication Data

US 2018/0131129 A1 May 10, 2018

(30) Foreign Application Priority Data

Nov. 7, 2016 (GB) ..... 1618767.6

(51) Int. Cl.

| | |
|---|---|
| ***H01R 13/15*** | (2006.01) |
| ***H01R 13/625*** | (2006.01) |
| ***H01R 12/71*** | (2011.01) |
| ***H01R 13/426*** | (2006.01) |
| ***H01R 13/631*** | (2006.01) |
| ***H01R 24/84*** | (2011.01) |
| ***H01R 43/26*** | (2006.01) |

(Continued)

(52) U.S. Cl.

CPC ..... *H01R 13/625* (2013.01); *H01R 12/716* (2013.01); *H01R 13/426* (2013.01); *H01R 13/631* (2013.01); *H01R 13/639* (2013.01); *H01R 24/84* (2013.01); *H01R 43/22* (2013.01); *H01R 43/26* (2013.01); *H01R 13/5208* (2013.01); *H01R 2107/00* (2013.01)

(58) Field of Classification Search

CPC ..... H01R 13/622; H01R 13/623

USPC ..... 439/259, 277, 320, 625

See application file for complete search history.

(56) References Cited

U.S. PATENT DOCUMENTS 5,662,488 A 9/1997 Alden ..... 439/314
9,395,499 B2 * 7/2016 Huang ..... G02B 6/3825

(Continued)

FOREIGN PATENT DOCUMENTS

CN 102136656 A 7/2011 ..... H01R 13/627

OTHER PUBLICATIONS

UK Search Report dated Mar. 13, 2017 in related application No. GB1618767.6.

*Primary Examiner* — Phuong Chi T Nguyen

(74) *Attorney, Agent, or Firm* — Renner Kenner Greive Bobak Taylor & Weber

(57) ABSTRACT

An apparatus for connecting two electrical connectors together includes a locking collar, a first electrical connector, and a second electrical connector. The first electrical connector includes one or more electrical contacts arranged to mate with one or more electrical contacts in the second electrical connector to form an electrical connection, and the collar is arranged to receive at least a portion of the connectors and releasably lock the first and/or second connector. At least one of the electrical connectors includes a main body portion with at least one channel on a surface for cooperating with the protrusion of the locking collar, and a contact portion with a cartridge positioned within the main body portion. The contact portion further includes at least a first male contact and a first female contact connected to the cartridge. A corresponding method and electrical connector are also provided.

20 Claims, 7 Drawing Sheets

(51) Int. Cl.

| | |
|---|---|
| ***H01R 13/639*** | (2006.01) |
| ***H01R 43/22*** | (2006.01) |
| *H01R 107/00* | (2006.01) |
| *H01R 13/52* | (2006.01) |

(56) References Cited

U.S. PATENT DOCUMENTS

| | | | | |
|---|---|---|---|---|
| 9,450,338 | B2 * | 9/2016 | Reeves | H01R 13/631 |
| 2009/0170364 | A1 | 7/2009 | Scholler et al. | 439/359 |
| 2014/0295690 | A1 | 10/2014 | Quero pacheco et al. | H01R 13/625 |
| 2015/0180167 | A1 | 6/2015 | Haas et al. | H01R 13/625 |
| 2015/0260924 | A1 * | 9/2015 | Huang | G02B 6/3825 385/60 |

* cited by examiner

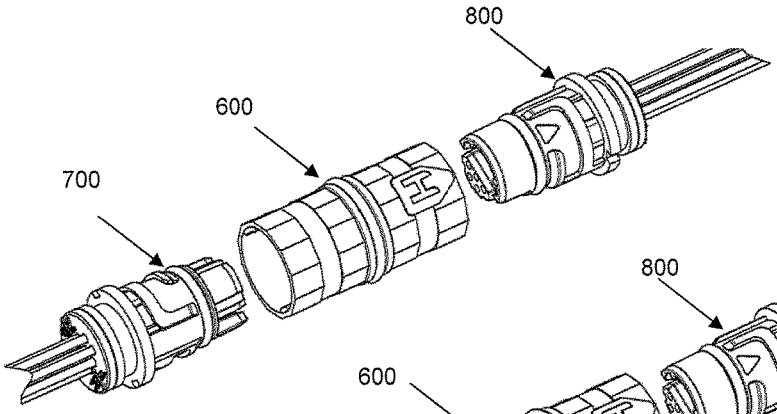
Fig. 12
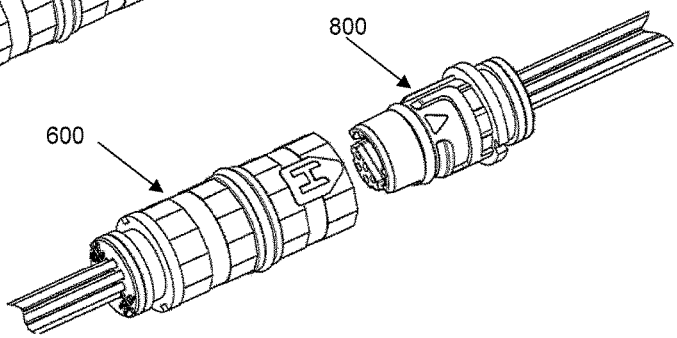
Fig. 13
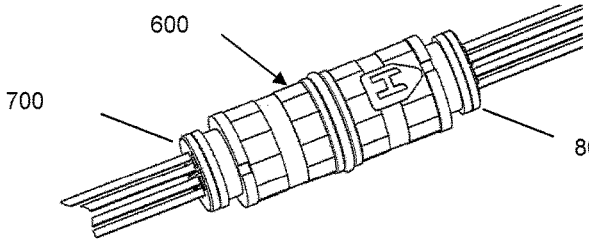
Fig. 14
Fig. 15
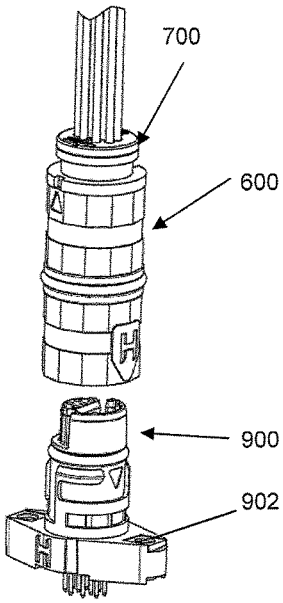
Fig. 16
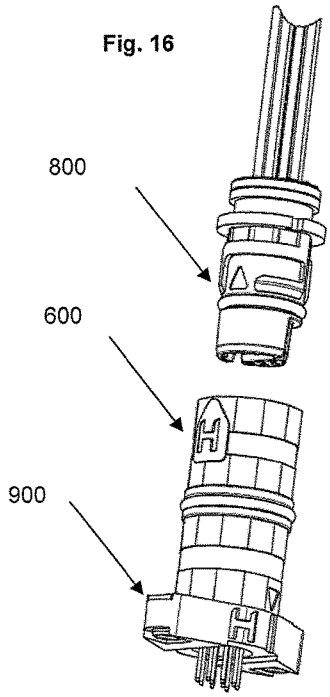

ELECTRICAL CONNECTOR

TECHNICAL FIELD

The present invention relates to electrical connectors and particularly an apparatus and method for connecting two electrical connectors together. Furthermore, an electrical connector, a locking collar and tool for use with the electrical connector are provided.

BACKGROUND OF INVENTION

An electrical connection can be made between two electrical devices usually using a male and female electrical contact. One part of the connection has a male contact with an electrical pin and the other part is a female contact in the form of a socket for receiving the male contact. In this manner, the male and female contacts cooperate with each other. Connectors also exist that include integrated male and female contacts in a single connector ("hermaphroditic connectors") such that a section of a first connector has male contacts and another section has female contact. Another identical connector may have respective male contacts and female contacts. The male and female contacts of the first connector can be aligned with the female and male contacts respectively of the other connector, and then connected together.

Once electrical connectors are mated, they are typically held together by engagement forces that arise from a male pin being engaged in order to fit into a female socket or a body housing the male pin being received by the female socket.

SUMMARY OF THE INVENTION

From a first aspect, the invention provides an apparatus for connecting two electrical connectors together, the apparatus comprising: a locking collar; a first electrical connector; and a second electrical connector; wherein the first electrical connector is arranged to engage with the second electrical connector to form an electrical connection, and the collar is arranged to receive at least a portion of the first and second connectors and releasably lock the first or second connector.

From a second aspect, an embodiment provides a locking collar for use in the aforementioned apparatus.

From a third aspect, the invention provides an electrical connector for use with the aforementioned collar.

From a fourth aspect, the invention provides a tool for use with the electrical connector of the third aspect, wherein one end of the tool comprises means for removing the at least first male contact and the at least first female contact from the cartridge of the electrical connector.

From a fifth aspect, the invention provides a method of connecting two electrical connectors together, comprising: releasably locking a locking collar to a body of a first electrical connector; mating one or more contacts of a second electrical connector to one or more electrical contacts of the first electrical connector; and releasably locking a body of the second electrical connector to the collar.

In an embodiment, an electrical connection arrangement is provided, comprising: two electrical connectors of the third aspect; and the locking collar of the second aspect.

BRIEF DESCRIPTION OF THE DRAWINGS

Embodiments of the invention will now be provided by way of example only with reference to the drawing in which:

FIG. 3 shows a perspective view of the connector pair and collar of FIG. 1 after mating between the first and second connectors, wherein FIG. 1 is an exploded view of this mated connector pair not the disassembled connector pair;

FIG. 12 shows an exploded perspective view of a connector pair and locking collar in accordance with a third embodiment;

FIG. 13 shows the locking collar of FIG. 12 locked to a first connector of the connector pair and aligned to receive a second connector of the connector pair, prior to mating between the first and second connectors;

FIG. 14 shows a perspective view of the connector pair and collar of FIG. 12 after mating between the first and second connectors, wherein FIG. 12 is an exploded view of this mated connector pair not the disassembled connector pair;

FIG. 15 shows a perspective view of a connector pair and collar according to a fourth embodiment where one connector is attached to part of a printed circuit board (PCB);

FIG. 16 shows a perspective view of a connector pair and collar of the fourth embodiment with the collar attached to the connector that is attached to part of the PCB;

BEST MODE FOR CARRYING OUT THE INVENTION

Figure 1:
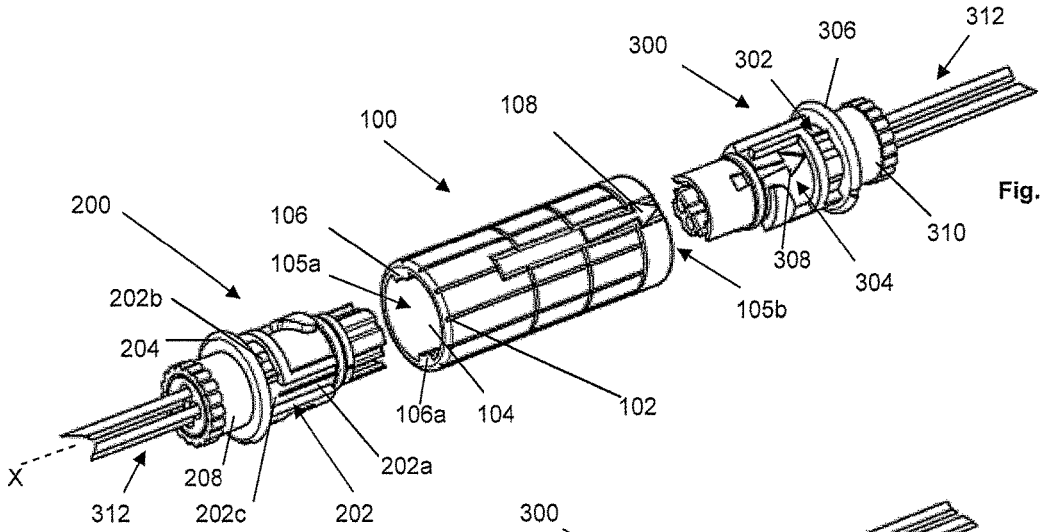
FIG. 1 shows an exploded perspective view of a connector pair and locking collar in accordance with a first embodiment.
Figure 2:
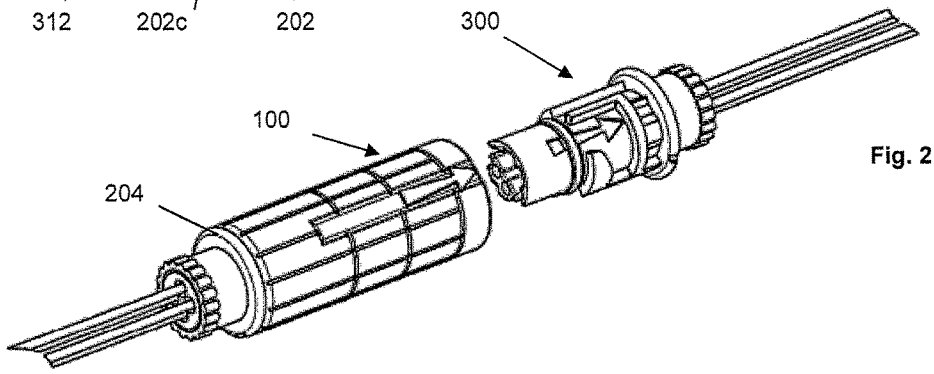
FIG. 2 shows the locking collar of FIG. 1 locked to a first connector of the connector pair and aligned to receive a second connector of the connector pair, prior to mating between the first and second connectors.
Figure 3:
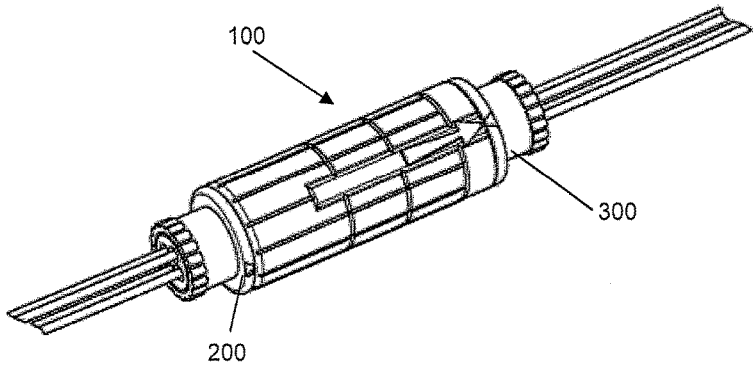

Referring to FIGS. 1 to 3, in a first embodiment, a locking collar 100 is provided which is releasably locked to a first electrical connector 200. A second electrical connector 300 which is identical to the first connector is then received in the collar 100. A different reference numeral is used for the second electrical connector 300 for ease of explanation but it is identical to the first electrical connector 200 save that it is turned 180 degrees so shows the underside of the first electrical connector. The second electrical connector 300 is mated to the first electrical connector 200 in the collar 100 to form a mated connector pair (see FIG. 3, for example). An electrical connection is formed between respective male and female electrical contacts within the first and second connectors. The locking collar 100 can be unlocked and removed from the first connector 200 and then locked to the second electrical connector 300. Therefore, the collar 100 can be easily swapped from being locked to one side of a mated connector pair to the other side and the collar 100 can be retained by one of the electrical connectors 200, 300 when they are not mated. The mated connector pair can be useful for providing an electrical interconnection. The collar 100 can protect the connector pair from the outside environment and/or prevent separation of the connector pair.

The collar 100 is preferably an open-ended cylindrical member 102 that has a rigid non-conductive body. A through hole 104 is provided in the collar 100 to form a hollow cylinder and each end of the collar 100 has an opening arranged to receive a respective electrical connector 200, 300. The diameter of the through hole in the collar 100 is chosen to enable the first electrical connector 200 to at least partially be received by the collar 100 such that the collar 100 surrounds and houses the received part of the first electrical connector 200.

The collar 100 is coupled to the first electrical connector 200 through a bayonet-type coupling to provide a releasable locking mechanism. As shown in FIG. 2, the first connector 200 has already been coupled to the first electrical connector 100. In this embodiment, the bayonet-type coupling is achieved by at least one protrusion 106 or notch on an inner surface of the collar 100 that is arranged to interact with an appropriately shaped first channel 202 on an outer surface of a main body portion of the first electrical connector 100. For example, the channel 202 may approximate a reverse L-shape such that in forming a mechanical connection between the collar 100 and the first connector 200, the protrusion 106 is moved through the channel which has a first part 202*a* that is in a parallel direction to the longitudinal axis X of the connector 100 and then a second part 202*b* that is substantially perpendicular (in a circumferential direction) to the longitudinal axis at an elbow 202*c* of the reverse L-shape. Accordingly, the protrusion 106 in the collar 100 is aligned with the entrance of the first part 202*a* of the channel 202 on the first connector 200, pushed through the first part 202*a* of the channel 202 and then turned through the second part 202*b* to lock the collar 100 to the first connector 200. The protrusion 106 is preferably located adjacent the opening at one end of the collar 100. Another identical or similar protrusion 106*a* may be located diametrically opposite the first protrusion 106. A channel 302 corresponding to the aforementioned channel is provided on the underside of the connector 200 to receive the identical protrusion (see, for example, connector 300 which shows the underside of the connector 200). It will be appreciated that other arrangements of protrusions may be provided.

The first connector 200 has a seat 204 or flange that extends outwards and around the main body of the connector 200. Once connected, an edge of the end of the collar where the projections 106, 106*a* are located is abutted with and sits on the seat 204 of the first connector 200. In one embodiment, the second part 202*b* of the channel 202 of the first connector 200 is adjacent the seat 204.

The second part 202*b* of the channel 202 has a distance and configuration to allow the protrusion 106 to form a locking configuration in two positions. The first position is at the end of the second part 202*b* of the L-shaped channel and locks the collar 100 to the first connector 200. The profile of the channel at the first position may be different to other non-locking positions to provide the locking function.

The other end of the collar 100 has an opening 105*b* (not clearly visible in FIG. 1-3 but see FIG. 4 for example) to receive the second electrical connector 300 that is identical to the first electrical connector but rotated 180 degrees. The other end of the collar 100 can also mechanically connect to the second electrical connector 300 after the collar 100 has locked with the first connector 200. The collar 100 has notch (not shown) near but displaced from an end of the collar 100, and arranged to cooperate with a second channel 304 in the main body portion (discussed in more detail below—see FIG. 6, for example) of the second electrical connector 300. In this embodiment, the channel 304 is different and in addition to the first channel 202 provided to lock the first connector 200 to the collar 100. That is, one of the channels is used by one connector to lock to one side of the collar 100 and the other channel is used to prevent removal of the second connector 300 from the other side of the collar 100. Similarly to the first connector 200, the collar 100 is seated on a seat 306 provided on the second connector 300, and the end of the collar 100 is flush with seat 306 on the connector 300.

The collar 100 can serve as a guide to the second connector 300 in the mating connector pair. The outer surface of the collar 100 has an appropriate alignment indicator such as an arrow 108 to help align with the second connector 300 which itself has an arrow 308 in the channel 304 that receives a notch (not shown) in the collar 100. It will be appreciated that although an arrow is not shown in the first connector 200, the underside of the first connector will have the same configuration as the top side of the second connector shown in FIGS. 1 and 2 given that the connectors 200,300 are identical. The notch to cooperate with the second channel 304 in the second connector 300 is preferably positioned on an inner surface of the collar 100 under the arrow 108 on the outer surface of the collar 100.

It will be appreciated that if the second connector 300 is turned, it will have the same configuration as the first connector 200 and be used to connect to the first end of the collar 100 (i.e. the side distal from the arrow 108 on the collar 100).

The second channel 304 that receives the notch on the other side of the collar 100 may also be an approximate reverse-L shape to provide a bayonet coupling. Other configurations may be provided to secure the second connector 300 to the collar 100 and prevent removal of the second connector 300 by pulling from the collar 100.

Once the collar 100 is locked to the first connector 200 by inserting the collar protrusion 106 into the channels 202 in the first connector 100 and rotating the collar 100 relative to the first connector 200 to the first position in second part 202*b* of the reverse-L shaped channel 202, in order to connect the second connector 300, the second connector's arrow 308 is aligned with the arrow 108 on the surface of the collar 100 and pushed into collar to electrically mate with first connector 200. The collar 100 is then rotated in an opposite direction that it was rotated to form the lock with the first connector 200 and to a lesser extent to secure the second connector main body to the collar 100. In this embodiment, the connectors themselves will not rotate as they will be mated to each other. The collar 100 is therefore rotatable with respect to the first connector 200 and second connector 300 within the confines of the respective channels in each. In other embodiments, rotatable outer surfaces of the connector may be provided.

In order to form the connection as shown in FIGS. 1 to 3 and when the collar 100 is viewed from the end that houses the first connector 200, the collar 100 receives the first connector 200 and is rotated anti-clockwise (for example, quarter turn) to the first position at the end of the channel 202 in the first connector 200. The second connector 300 is inserted into the other end of the collar 100 and the second connector 300 is mated with the first connector 200. The collar 100 is rotated clockwise to a lesser extent (for example, an eighth turn) to near or the end of the cooperating channel 304 in the second connector 300, the protrusions of the collar 100 that are in the second part 202*b* of the channel 202 of the first connector 200 rotating clockwise and stopping at a second position in the second part 202*b* of the channel 202. The second position may be half way between the end of the second part of the channel 202 and the elbow 202*c* of the L-shape of the channel 202 and, similarly to the first position, the profile at the second position may differ to the rest of the channel to retain the notch 106 in the channel 202.

In this embodiment, the connectors 200, 300 include a retaining heat shrink rubber boot 208, 310 adjacent the respective seat 204,306 on the other side that the collar 100 is seated in use. Wires 312 extend from the connectors away from the rubber boot. It will be appreciated that the rubber boot is not essential to provide the releasable locking mechanism and is not necessarily rubber but instead can be a rigid feature forming part of the connector 200, 300.

Figure 4:
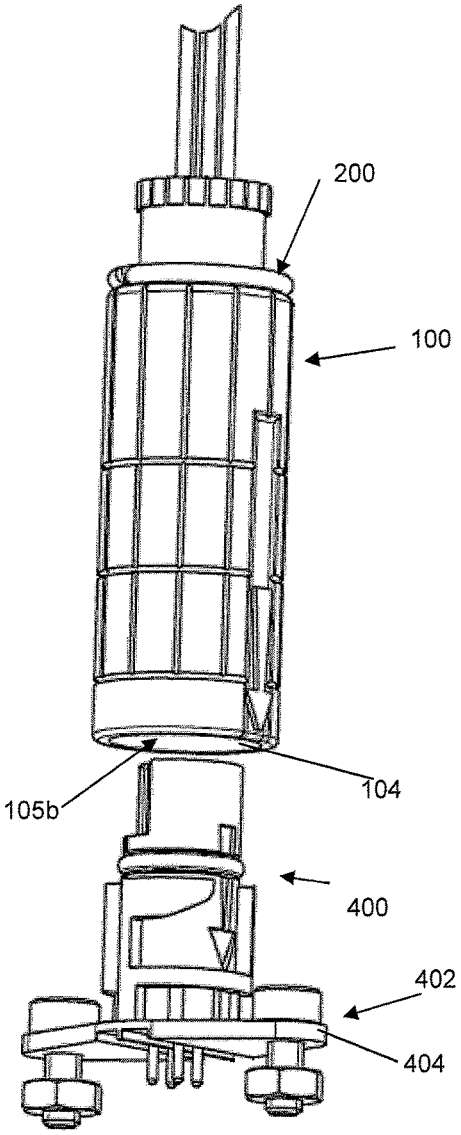
FIG. 4 shows a perspective view of a connector pair and collar according to a second embodiment where one connector is attached to part of a printed circuit board (PCB)

In another embodiment as shown in FIG. 4, an electrical connector 400 is attached to a support structure 402 that mounts the connector 400 to a printed circuit board (not shown), for example. Instead of a surface of a seat 306 as in the connector 300 of FIGS. 1 to 3, the collar 100 is flush with a surface 404 of the support structure 402 once the connector 400 is received by the collar 100. The connector 400 has the same channels 202, 304 as provided in the connectors 200, 300 so the description is not repeated here. The construction and functionality of the collar 100 and connector 200 is the same as that described above so is not repeated.

Figure 5:
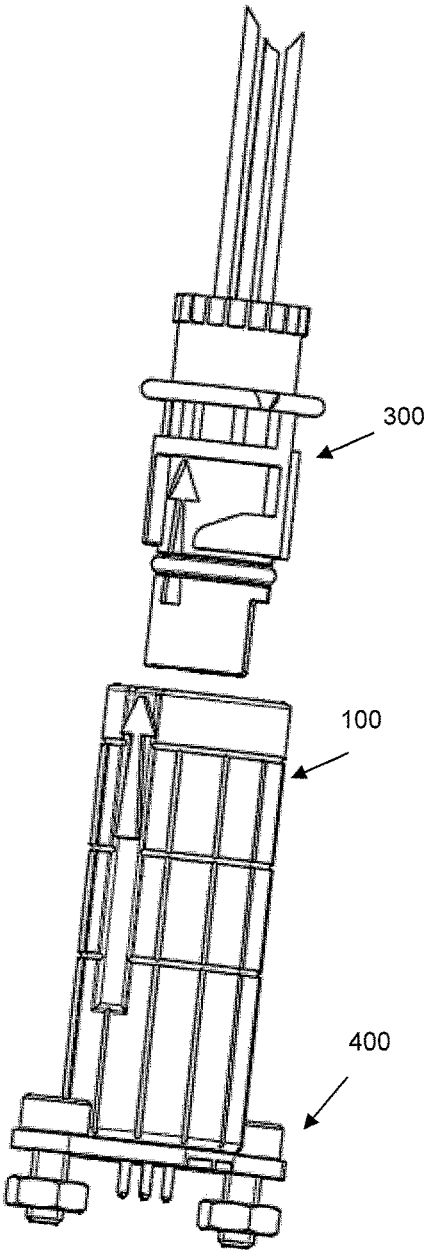
FIG. 5 shows a perspective view of a connector pair and collar of the second embodiment with the collar attached to the connector that is attached to part of the PCB.

In the embodiment shown in FIG. 5, the connector 400 is oriented in a similar way to connector 200 in FIGS. 1 and 2 and connected to the collar 100. The collar 100 then receives the connector 300 which is oriented in a similar way to connector 300 in FIGS. 1 to 2.

As will be apparent to the skilled person with the benefit of this disclosure, the collar is removable and replaceable on the connectors 200, 300 (identical to connector 200 but rotated 180 degrees), 400. The collar can be easily swapped from one side of the mated connector pair to the other side and only one of the two connectors retains the collar when the connectors are not mated.

It will be appreciated that two channels may not necessarily be provided in the connector 200, 300. A single channel or other suitable mechanism on the connector could be provided to allow for bayonet locking with one of the connectors and then retention of another identical connector. Further, the collar may be adapted to act as a guide only with the second connector 300 rather than locking it through a bayonet mechanism with the collar such that the channel to connect to the second connector may only have a channel that is substantially parallel to the longitudinal axis of the second connector and not have a substantially perpendicular part.

Further aspects of the connector 300 will now be described with reference to FIGS. 6 to 11. Although only connector 300 is referred to, this is for ease of reference. Connector 200 has identical features as it is identical to the connector 300.

The connector 300 includes an assembly comprising a main body portion 320 that may be non-conductive and includes the channels 202, 304 referred to above to provide the coupling between the connector 300 and the collar 100. The main body portion 320 is a housing for electrical contacts and is substantially cylindrical having a substantially hollow body with a circular cross section. The main body has a central longitudinal axis X.

The assembly further includes a contact portion 330 having at least a male contact 332 and a female contact 334 located within the main body portion 320. In this embodiment, there are two male contacts 332 on a top D-section 316*a* of body portion 320 and two female contacts in a bottom D-section 316*b* of the body portion 320. Each contact 332,334 is electrically connected to a wire 312 such that four wires are provided to the connector 300.

Figure 7:
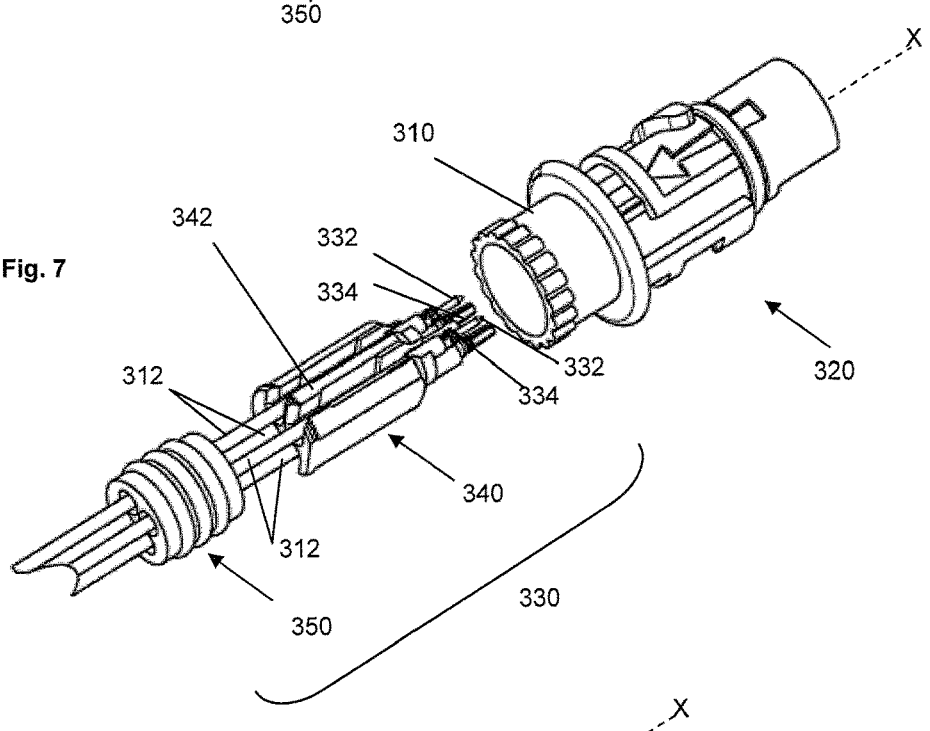
FIG. 7 shows a partially exploded view of the connector of FIG. 6.
Figure 8:
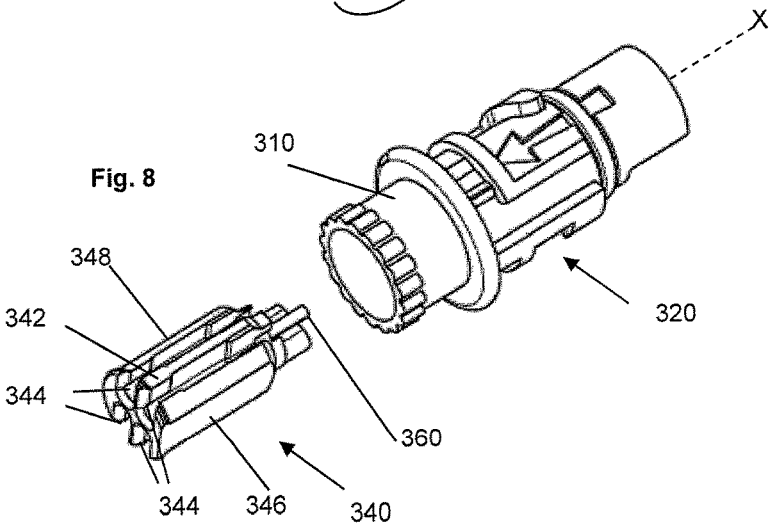
FIG. 8 shows the connector of FIG. 7 but with contacts, wires and the seal removed for clarity.

With particular reference to FIGS. 7 and 8, the contact portion further includes a cartridge 340 to aid with assembly of the contacts in the main body 320 of the connector 300 and retention of the contacts within the main body of the connector 300. The cartridge 340 has a body 342 that may be non-conductive and forms four pathways 344 extending substantially parallel to the longitudinal axis X of the connector main body 320 that can receive respective wires 312 of each of the four contacts 332,334 such that the contacts are exposed from one side of the cartridge 340. In this embodiment, the pathways 344 are D-shaped to allow the wire to enter from one side of the "D", although other shapes are possible. The construction of the cartridge 340 can assist with alignment of the cartridge 340 within the main body portion 320 of the connector 300. To this end, a base 346 of the cartridge 340 is flat and a top 348 of the cartridge 340 may be curved. The cartridge 340 cooperates with one or more grooves (not shown) in the main body portion 320 of the connector 300 to provide a snap fit feature to retain the cartridge 340 by locking into the one or more grooves inside the main body portion 340.

Adjacent the cartridge 340 on the other side of the cartridge to where the contacts 332,334 are located and displaced along the longitudinal axis from the cartridge 340, a wire seal 350 is attached to the assembly of the contact portion 330. The wire seal 350 has a body with four through holes for each respective wire 312 and, when assembled, is located within and flush with the end of the boot 310 in the main body portion 320 of the connector 300. This allows for easy placement of individual wired contacts into the cartridge 340 and then all the contacts in the cartridge to be latched in the main body portion 320 in one step.

Figure 9:
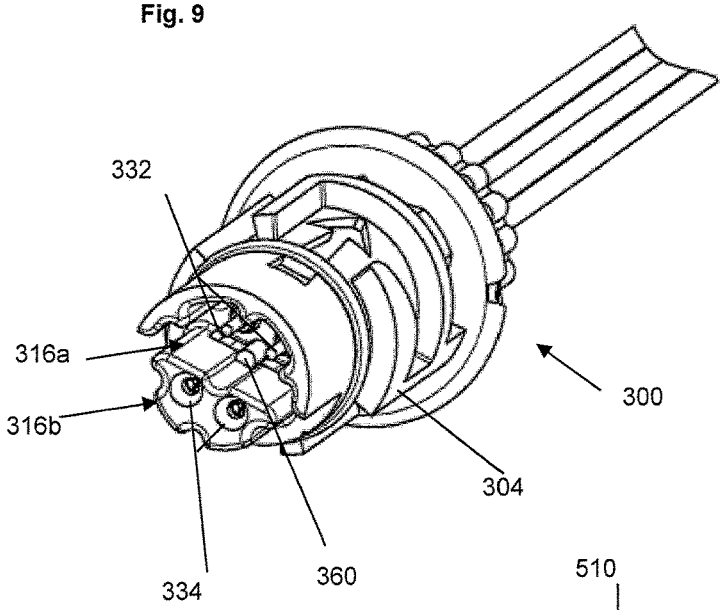
FIG. 9 shows another view of the connector of FIG. 6.

The cartridge 340 comprises a release mechanism to enable release of the contacts 332,334 from the cartridge 340. This can be achieved by a release button 360 in the cartridge 340 as shown in FIGS. 8 and 9. The release (or eject) button 360 can be pressed allowing the cartridge 340 to be released from the main body portion 320 of the connector 300. Male contacts 332 and female contacts 334 can then be released from the cartridge 340, for example, by expanding part of each pathway 344 in the cartridge 340 to enable release. The release button 360 is located substantially in the centre of the imaginary cross section rectangular shape formed by the contacts 332,334.

Figure 10:
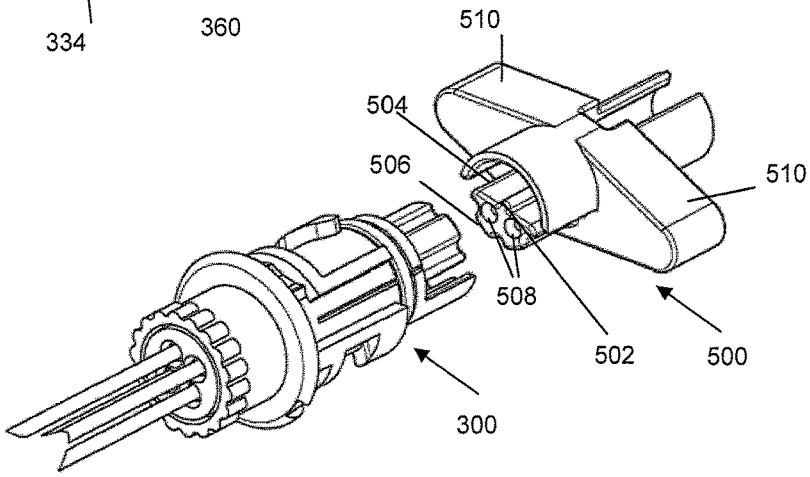
FIG. 10 shows the connector of FIG. 6 and a tool used to cooperate with the connector, the tool being used to remove contacts from the connector.

An appropriate tool 500 is provided to interact with the release button (see FIG. 10). The tool 500 comprises, at a front end, a release projection 502 that cooperates with the release button 360 in the connector 300 to release the contacts 332,334 from the cartridge 340. The tool may have a profile that can partially fit into the top and bottom D-sections of the connector such that one half has a cavity 504 to receive the bottom D-section 316*b* of the body portion 320 of the connector that includes the female contacts 334 and the other half has a solid body 506 with two recesses 508 to receive the top D-section 316*a* of body portion 320 of the connector 300 where the male contacts 332 are located. The tool 500 may include a gripping means which can be a pair of radially extending members 510 to aid with griping of the tool.

Therefore, cartridge 340 release mechanism can use tool 500 as shown in FIG. 10 such that release projection 502 pushes eject button 360 when located in the connector 300 as shown in FIG. 9 to release cartridge 340 containing contacts 332 and 334 from connector assembly 200 or 300. The contacts 332 and 334 can then be removed from the cartridge 340. Specifically, by releasing the cartridge 340, it is meant that the cartridge 340 is pushed back a small amount (approx. 1 mm) to release it from the snap lock feature. This then means that the cartridge 340 can then be removed or disassembled from main body portion 320 by pulling gently on the wires 312. The cartridge 340 still containing contacts 332 and 334 will then slide out of the assembly with little resistance, to an arrangement similar to that shown in FIG. 7. The contacts 332 and 334 can then be removed from the cartridge 340 by sliding along the contact axis to remove them from the seating cups, then when no longer restricted axially, the wire can be removed from the cartridge sideways out of the D-shaped slot in the cartridge. This allows the contacts/wires to be repaired/replaced or the position swapped.

Figure 11:
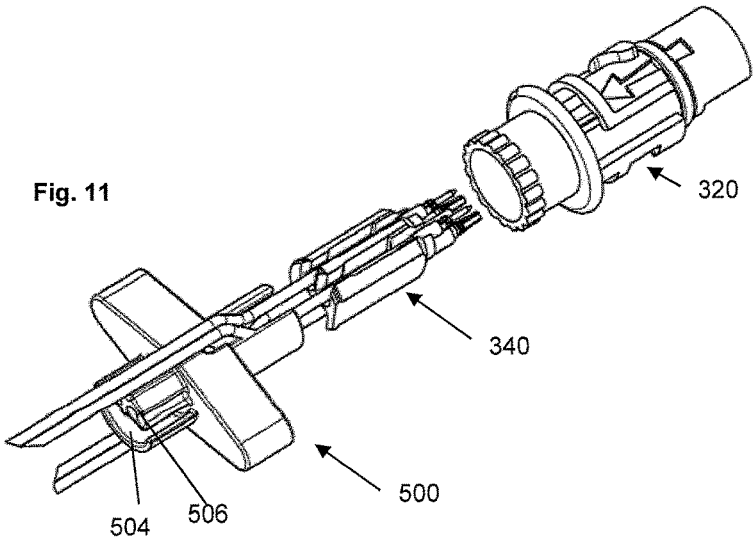
FIG. 11 shows the tool of FIG. 10 used to assemble contacts to a housing of the connector.

As shown in FIG. 11, the back end of the same tool 500 is configured to assist with assembly of the contacts 332,334 and cartridge in the main body portion 320 and to lock the contact portion 330 in position in the main body portion 320 of the connector 300. This end has an opening to receive wires 312 of the contact portion 320 of the connector 300. The wire seal of the contact portion 320 can then be added.

In further embodiments as shown in FIGS. 12 to 19, a collar 600 with the same functionality as that in the embodiment relating to FIGS. 1 to 5 is provided and will therefore not be described in detail here. Electrical connectors 700, 800 are provided which are essentially the same as those in the embodiment of FIGS. 1 to 11 except for a few differences that will now be described. Only the main differences will be described with reference to FIGS. 12 to 19. Similarly to the connectors in the embodiment of FIG. 6, the alternative connector comprises at least one male and female contact but in this embodiment there are ten contacts: five male contacts and five female contacts. It will be appreciated by the skilled person with the benefit of the disclosure that other numbers of contacts can be provided.

Similarly to the first and second embodiment which shows four contacts, further aspects of the connector 800 will now be described with reference to FIGS. 17 to 19. Although only connector 800 is referred to, this is for ease of reference. Connector 700 has identical features as it is identical to the connector 800.

Figure 6:
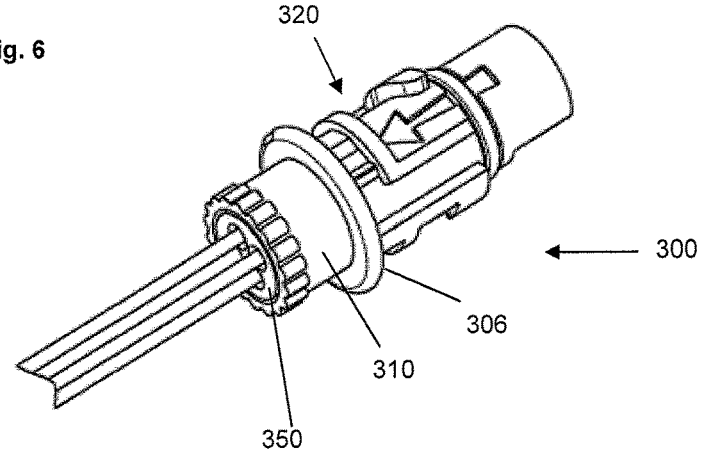
FIG. 6 shows a perspective view of a connector used in FIGS. 1 to 3 and 5.

The connector 800 includes an assembly comprising a main body portion 820 that may be non-conductive and includes the channels 804 which correspond to the channels 202, 304 in the first embodiment referred to in relation to the embodiment of FIG. 6 to provide the coupling between the connector 800 and the collar 600. The main body portion 820 is a housing for electrical contacts and is substantially cylindrical having a substantially hollow body with a circular cross section. The main body has a central longitudinal axis X.

The assembly further includes a contact portion 830 having at least a male contact 832 and a female contact 834 located within the main body portion 820. In this embodiment, there are five male contacts 832 on a top D-section 816*a* of body portion 820 (only three are visible in FIG. 19) and five female contacts 834 in a bottom D-section 816*b* of the body portion 820. Each contact 832,834 is electrically connected to a wire 812 such that ten wires are provided to the connector 800.

Figure 17:
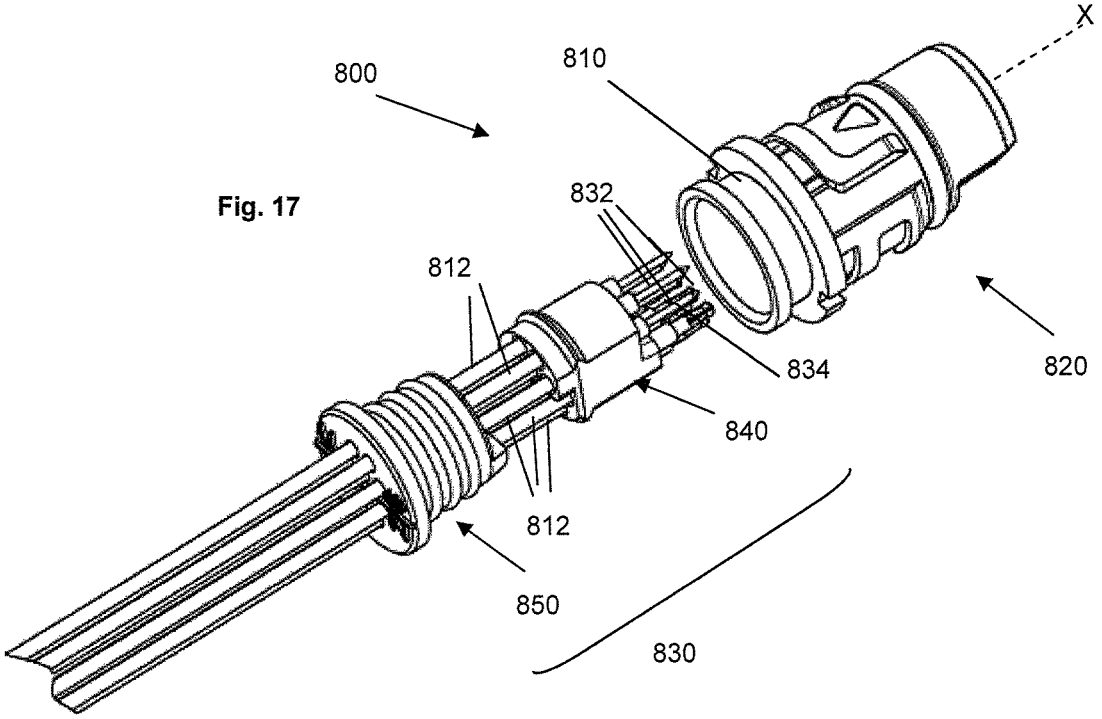
FIG. 17 shows a partially exploded view of the one of the connectors of FIGS. 12 to 16.
Figure 18:
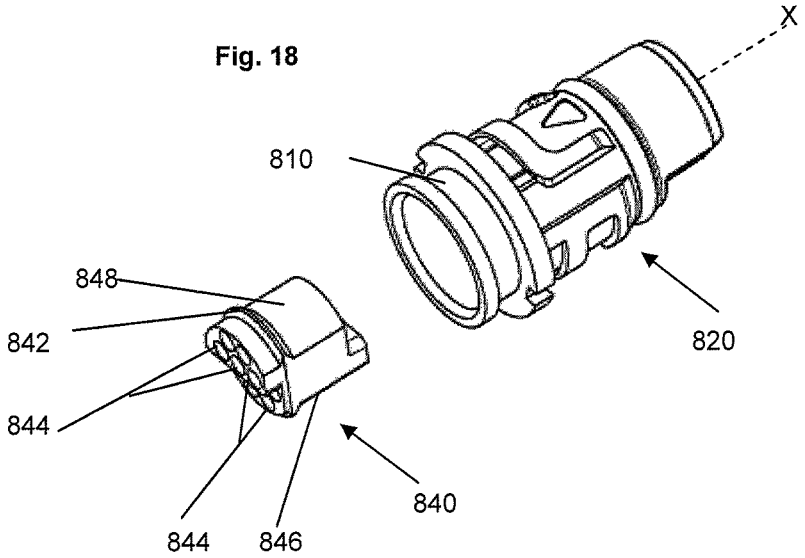
FIG. 18 shows the connector of FIG. 17 but with contacts, wires and the seal removed for clarity.
Figure 19:
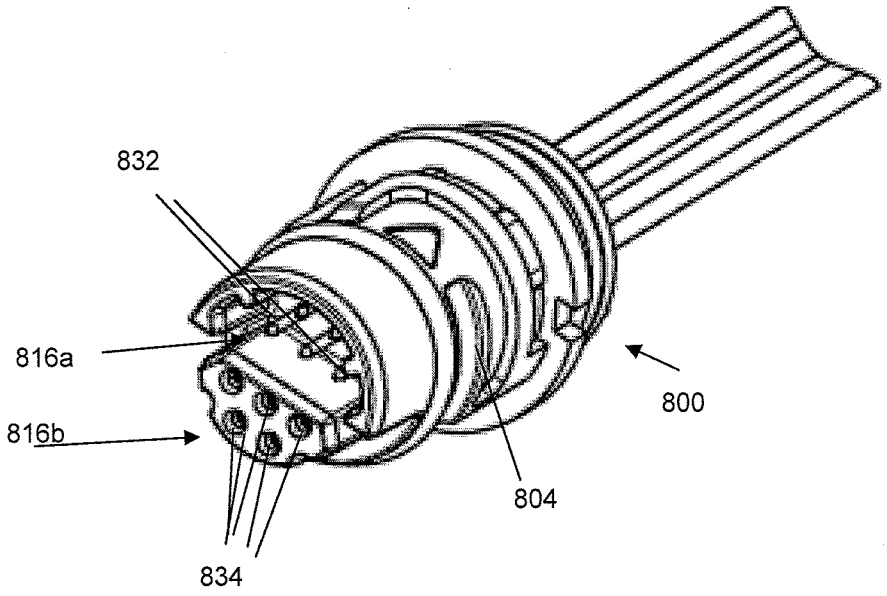
FIG. 19 shows another view of the one of the connectors of FIGS. 12 to 16.

With particular reference to FIGS. 17 and 18, the contact portion further includes a cartridge 840 to aid with assembly of the contacts in the main body 820 of the connector 800 and retention of the contacts within the main body of the connector 800. The cartridge 840 has a body 842 that may be non-conductive and forms ten pathways 344 (not all pathways are visible in FIG. 18) extending substantially parallel to the longitudinal axis X of the connector main body 820 that can receive respective wires 812 of each of the ten contacts 832,834 such that the contacts are exposed from one end of the cartridge 840. The pathways 344 can be through holes in the body 842 of the cartridge 840. In this embodiment, each wire 812 is fed through a respective pathway 844 which may have a circular cross section although other shapes are possible. Differently to the arrangement shown in FIG. 6, the cartridge 840 does not include slots in the side of the cartridge as this has not been found to be practical for the connector that includes more than four contacts and in particular the ten contact connector 800 of this embodiment. The construction of the cartridge 840 can assist with alignment of the cartridge 840 within the main body portion 820 of the connector 800. To this end, a base 846 of the cartridge 840 is flat and a top 848 of the cartridge 840 may be curved although other constructions could be used depending on the particular connector. The cartridge 840 cooperates with one or more grooves (not shown) in the main body portion 820 of the connector 800 to provide a snap fit feature to retain the cartridge 840 by locking into the one or more grooves inside the main body portion 820. This allows for easy placement of individual wired contacts into the cartridge 840 and then all the contacts in the cartridge 840 to be latched in the main body portion 820 in one step.

Adjacent the cartridge 840 on the other side of the cartridge to where the contacts 832,834 are located and displaced along the longitudinal axis from the cartridge 840, a sealing member in the form of a wire seal 850 is attached to the assembly of the contact portion 830. The wire seal 850 has a body with ten through holes for each respective wire 812 and, when assembled, is located within and flush with the end of the a boot 810 in the main body portion 820 of the connector 800. The seal 850 performs an assembly operation of the contact portion 830 to the main body portion 820 such that a tool (such as in the first embodiment) may not be needed. The seal 850 may be formed of rubber or some other material that allows the wires 812 to be received and the seal to be securely received by the main body portion 820.

In the embodiment as shown in FIGS. 15 and 16 which is essentially the same as the embodiment shown in FIGS. 4 and 5 except that ten contacts are provided in each connector of the present embodiment, an electrical connector 900 is attached to a support structure that mounts the connector 900 to a printed circuit board (not shown), for example. Instead of a surface of a seat 306 as in the connector 300 of FIGS. 1 to 3, the collar 900 is flush with a surface of the support structure 902 once the connector 900 is received by the collar 600. The connector 900 has the same channels 202, 304 as provided in the connectors 200, 300 so the description is not repeated here. The construction and functionality of the collar 600 and connector 700 is the same as that described above so is not repeated.

In the embodiment shown in FIG. 16, the connector 900 is oriented in a similar way to connector 700 in FIGS. 12 and 13 and connected to the collar 600. The collar 600 then receives the connector 800 which is oriented in a similar way to connector 800 in FIGS. 12 to 13.

In addition to the embodiments of the invention described in detail above, the skilled person will recognize that various features described herein can be modified and combined with additional features, and the resulting additional embodiments of the invention are also within the scope of the invention.

In addition to the claimed embodiments in the appended claims, the following is a list of additional embodiments which may serve as the basis for additional claims in this application or subsequent divisional applications:

Embodiment 1

An apparatus for connecting two electrical connectors together, the apparatus comprising:

a locking collar;

a first electrical connector; and a second electrical connector;

wherein the first electrical connector comprises one or more electrical contacts arranged to mate with one or more electrical contacts in the second electrical connector in order to form an electrical connection, and the collar is arranged to receive at least a portion of the first and second connectors and releasably lock the first and/or second connector.

Embodiment 2

The apparatus of Embodiment 1, wherein the collar comprises a through hole.

Embodiment 3

The apparatus of Embodiment 1 or 2, wherein the collar has a first and second ends and openings at each end.

Embodiment 4

The apparatus of Embodiment 1, 2 or 3, wherein the through hole is shaped to receive the portion of the first and second electrical connector and collar houses the received portion.

Embodiment 5

The apparatus of any preceding Embodiment, wherein the collar is substantially cylindrical and/or hollow.

Embodiment 6

The apparatus of any preceding Embodiment, wherein the first and/or second electrical connector has a housing and the collar has at least one protrusion on an inner surface, the protrusion arranged to cooperate with the housing of at least one of the first and second electrical connectors to lock the collar to the first or second electrical connector.

Embodiment 7

The apparatus of Embodiment 6, wherein housing comprises a first channel on an outer surface thereof, and the protrusion is arranged to cooperate with the first channel.

Embodiment 8

The apparatus of Embodiment 7, wherein the housing comprises a second channel on an outer surface thereof to interact with a notch near another end of the collar.

Embodiment 9

The apparatus of any preceding Embodiment, wherein the collar is rotatable with respect to the first and second connectors after mating of the first and second electrical connectors and prior to releasably locking the first and second connectors together.

Embodiment 10

The apparatus of any preceding Embodiment, wherein the releasable lock is a bayonet type connection.

Embodiment 11

The apparatus of any preceding Embodiment, wherein the outer surface of the collar comprises alignment indicia to aid with the alignment of the two connectors prior to mating of the two connectors.

Embodiment 12

The apparatus of any preceding Embodiment, wherein a surface of the electrical connector comprises alignment indicia to aid with the alignment of the two connectors prior to mating of the two connectors.

Embodiment 13

The apparatus of any preceding Embodiment, wherein one end of the first or second connector comprises means for mounting the connector to a printed circuit board (PCB).

Embodiment 14

The apparatus of any preceding Embodiment, wherein each connector comprises a housing and one end of each connector housing comprises one or more wires extending therefrom.

Embodiment 15

The apparatus of any preceding Embodiment, wherein the first and second connectors are the same.

Embodiment 16

A locking collar for use with the apparatus of any preceding Embodiments, the locking collar comprising a through hole and at least one protrusion on an inner surface projecting inwards.

Embodiment 17

An electrical connector for use with a locking collar of Embodiment 16, comprising a main body portion comprising at least one channel on a surface for cooperating with the protrusion of the collar, and a contact portion comprising a cartridge positioned within the main body portion, wherein the contact portion further comprises at least a first male contact and a first female contact connected to the cartridge.

Embodiment 18

The electrical connector of Embodiment 17 wherein the contact portion comprises a release button to release the contacts from the cartridge.

Embodiment 19

The electrical connector of Embodiment 18, wherein the release button is located to be accessed from a front opening of the connector, the front opening comprising the first male and female contacts.

Embodiment 20

A tool for use with the electrical connector of any of Embodiments 17 to 19, wherein one end of the tool comprises means for removing the at least first male contact and the at least first female contact from the cartridge of the electrical connector.

Embodiment 21

The tool of Embodiment 20, wherein another end of the tool comprises means for assisting with assembly of the contacts and cartridge in the main body portion of the connector and to lock the contact portion in position in the main body portion of the connector.

Embodiment 22

A method of connecting two electrical connectors together, the method comprising:

releasably locking a locking collar to a body of a first electrical connector;

mating one or more contacts of a second electrical connector to one or more electrical contacts of the first electrical connector;

releasably locking a body of the second electrical connector to the collar.

Embodiment 23

An electrical connection arrangement comprising: two electrical connectors of any of Embodiments 17 to 19; and a locking collar according to Embodiment 16.

The invention claimed is:

1. An apparatus for connecting two electrical connectors together, the apparatus comprising:

a locking collar having at least one protrusion;

a first electrical connector; and a second electrical connector;

wherein the first electrical connector comprises one or more electrical contacts arranged to mate with one or more electrical contacts in the second electrical connector in order to form an electrical connection, and the collar is arranged to receive at least a portion of the first and second connectors and releasably lock the first and/or second connector, and wherein at least one of the first electrical connector and the second electrical connector comprises a main body portion comprising at least one channel on an outer surface for cooperating with the at least one protrusion of the locking collar, and a contact portion comprising a cartridge positioned within the main body portion, wherein the contact portion further comprises at least a first male contact and a first female contact connected to the cartridge.

2. The apparatus of claim 1, wherein the collar is substantially cylindrical and/or hollow.

3. The apparatus of claim 1, wherein the collar is rotatable with respect to the first and second connectors after mating of the first and second electrical connectors and prior to releasably locking the first and second connectors together, and, optionally, the releasable lock is a bayonet type connection.

4. The apparatus of claim 1, wherein the outer surface of the collar and/or the surface of the electrical connector comprises alignment indicia to aid with the alignment of the two connectors prior to mating of the two connectors.

5. The apparatus of claim 1, wherein one end of the first or second connector comprises means for mounting the connector to a printed circuit board (PCB).

6. The apparatus of claim 1, wherein the cartridge is adapted to receive wires, one end of each wire including the male and female electrical contacts, and the wires are removable from the cartridge when the cartridge is disassembled from the main body portion of the connector.

7. The apparatus of claim 1, wherein the first and second connectors are the same.

8. The apparatus of claim 1, wherein each connector comprises at least four electrical contacts.

9. The apparatus of claim 1, wherein each connector comprises at least ten electrical contacts.

10. The apparatus of claim 1, wherein the collar comprises a through hole having first and second ends and openings at each end.

11. The apparatus of claim 10, wherein the through hole is shaped to receive the portion of the first and second electrical connector and collar houses the received portion.

12. The apparatus of claim 1, wherein the first and/or second electrical connector has a housing comprising the outer surface and the collar has said at least one protrusion on an inner surface, the protrusion arranged to cooperate with the housing of at least one of the first and second electrical connectors to lock the collar to the first or second electrical connector.

13. The apparatus of claim 12, wherein housing comprises a first channel on the outer surface thereof, and the protrusion is arranged to cooperate with the first channel.

14. The apparatus of claim 13, wherein the housing comprises a second channel on the outer surface thereof to interact with a notch near another end of the collar.

15. An electrical connector for use with a locking collar comprising a locking collar comprising a member having a through hole with an inner surface from which projects at least one protrusion;

a connector comprising a main body portion with at least one channel on an outer surface for cooperating with the at least one protrusion of the collar, and a contact portion comprising a cartridge positioned within the main body portion, wherein the contact portion further comprises at least a first male contact and a first female contact connected to the cartridge.

16. The electrical connector of claim 15 wherein the contact portion comprises a release button to release the contacts from the cartridge.

17. The electrical connector of claim 16, wherein the release button is located to be accessed from a front opening of the connector, the front opening comprising the first male and female contacts.

18. The apparatus of claim 15, further comprising a tool, wherein one end of the tool comprises means for removing the at least first male contact and the at least first female contact from the cartridge of the electrical connector.

19. The apparatus of claim 18, wherein another end of the tool comprises means for assisting with assembly of the contacts and cartridge in the main body portion of the connector and to lock the contact portion in position in the main body portion of the connector.

20. A method of connecting two electrical connectors together, the method comprising:

releasably locking a locking collar to a body of a first electrical connector, the locking collar having at least one protrusion;

mating one or more contacts of a second electrical connector to one or more electrical contacts of the first electrical connector;

releasably locking a body of the second electrical connector to the locking collar, wherein at least one of the first electrical connector and the second electrical connector comprises a main body portion comprising at least one channel on an outer surface for cooperating with the at least one protrusion of the locking collar, and a contact portion comprising a cartridge positioned within the main body portion, wherein the contact portion further comprises at least a first male contact and a first female contact connected to the cartridge.

* * * * *